United States Patent [19]

Ryan

[11] Patent Number: 4,771,209

[45] Date of Patent: Sep. 13, 1988

[54] SPARK IGNITER HAVING PRECIOUS METAL GROUND ELECTRODE INSERTS

[75] Inventor: Nolan A. Ryan, Toledo, Ohio

[73] Assignee: Champion Spark Plug Company, Toledo, Ohio

[21] Appl. No.: 592,288

[22] Filed: Mar. 22, 1984

Related U.S. Application Data

[63] Continuation-in-part of Ser. No. 333,440, Dec. 22, 1981, abandoned, which is a continuation of Ser. No. 86,755, Oct. 22, 1979, abandoned.

[51] Int. Cl.[4] ..... H07T 13/32

[52] U.S. Cl. ..... 313/140; 313/141

[58] Field of Search ..... 313/139, 140, 141, 142

[56] References Cited

U.S. PATENT DOCUMENTS

| | | | |
|---|---|---|---|
| 2,108,525 | 2/1938 | Carrington | 313/140 |
| 2,344,597 | 3/1944 | Chaston et al. | 313/141 X |
| 2,391,455 | 12/1945 | Hensel | 313/142 |
| 2,391,456 | 12/1945 | Hensel | 313/11.5 |
| 2,391,458 | 12/1945 | Hensel | 428/65 |
| 2,470,033 | 5/1949 | Hensel | 313/142 |
| 2,591,718 | 4/1952 | Paul | 313/140 |
| 2,603,200 | 7/1952 | Feichter | 313/140 X |
| 2,652,043 | 9/1953 | Johnson | 313/140 |
| 3,300,672 | 1/1967 | Fisher | 313/140 X |
| 3,691,419 | 9/1972 | Van Uum et al. | 313/139 X |
| 3,725,715 | 4/1973 | Krow | 313/141 X |

*Primary Examiner*—David K. Moore
*Assistant Examiner*—K. Wieder
*Attorney, Agent, or Firm*—MacMillan, Sobanski & Todd

[57] ABSTRACT

A spark igniter is disclosed. The igniter comprises a metal shell having a firing end which terminates at its lower end in an annular ground electrode, an insulator, a center electrode and a plurality of inserts embedded within and bonded to the metal shell. The insulator is sealed within the metal shell and has a central bore within which the center electrode is sealed and a surface extending inwardly toward the bore from the ground electrode. The center electrode has a firing end which is in spark gap relation with the ground electrode of the metal shell and is so positioned that a spark discharge between the firing end and the ground electrode occurs along the inwardly extending surface of the insulator. The inserts are composed of an oxidation and erosion resistant material, for example iridium, platinum, rhodium, ruthenium, osmium, tungsten or an alloy or ductile alloy of one of the foregoing metals.

6 Claims, 2 Drawing Sheets

SPARK IGNITER HAVING PRECIOUS METAL GROUND ELECTRODE INSERTS

REFERENCE TO RELATED APPLICATIONS

This is a continuation-in-part of application Ser. No. 333,440, filed Dec. 22, 1981, now abandoned, which application, in turn, was a continuation of Ser. No. 86,755, filed Oct. 22, 1979, now abandoned.

BACKGROUND OF THE INVENTION

The present invention relates to a spark igniter of the type used in turbine engines, including aircraft jet engines. Such igniters are frequently surface gap spark plugs in which a high energy spark discharge occurs between a center electrode and a ground electrode, traveling along the surface of a ceramic member. The spark discharge in such igniters is of the "high energy type" because of the nature of the ignition system used to cause sparking. The system includes a condenser which is charged as the voltage applied thereto and across the igniter increases; when the applied voltage becomes sufficiently large to cause a spark discharge the electrical energy stored by the capacitor is discharged, flowing across the spark gap. The stored energy in capacitor discharge ignition systems that are used with jet aircraft engines is usually at least one joule.

Electrode erosion has been a problem with spark igniters used with turbine engines for jet aircraft, sometimes constituting the limiting condition with respect to igniter life. Problem erosion of both the center electrode and the ground electrode occurs in igniters used with turbine engines. Conventional igniter ground electrodes are frequently made from inconel or from other conventional nickel alloys because, although they erode at a relatively rapid rate under service conditions, they are relatively inexpensive. A solution to the problem of electrode erosion in such igniters is suggested in U.S. Pat. No. 3,691,419, Van Uum et al.; this patent discloses an igniter of the type in question having a center electrode with a firing end made of spark resistant metal such as tungsten and a ground electrode having a ductile iridium ring welded therein and positioned so that it is immediately adjacent the spark gap. In the igniter of the Van Uum et al. patent, the ground electrode to which the iridium ring is welded is a portion of the metal shell of the igniter, a common structure.

It has been found that iridium and other precious metal rings, if they can be obtained at all, are extremely expensive. On the basis of price quotations that have been received, it has been estimated that the use of an iridium ring of the the type suggested by the Van Uum et al. patent in an igniter that is presently commercially available would approximately double the cost of that igniter. It has also been found that the differences in thermal expansion characteristics between iridium and the nickel alloys commonly used as ground electrode materials therein can cause catastrophic failure of igniters of the type suggested by Van Uum et al.

Various suggestions* have also been made for reducing electrode erosion in conventional spark plugs where the spark discharge occurs through a gas-filled gap between center and ground electrodes. What it calls a spark plug with "a multiplicity of semi-surface spark gaps" is suggested in U.S. Pat. No. 2,591,718 to Paul; this patent discloses a structure wherein a center electrode terminates flush with an insulator end and is in spark gap relation along the insulator end with four rod-type electrodes each of which just touches the insulator surface.

*See, for example, U.S. Pat. Nos. 2,391,455; 2,391,456; 2,391,458; 2,470,033 (all to Hensel); and 2,344,597 (to Chaston et al.). The Chaston et al. patent discloses a ground electrode made of a molybdenum platinum alloy wire which constitutes an insert in the metal shell of a conventional spark plug.

BRIEF DESCRIPTION OF THE PRESENT INVENTION

The instant invention is based upon the discovery of a ground electrode configuration for a spark igniter which does not require the expensive and difficult to obtain iridium ring of the spark plug suggested by the Van Uum et al. patent, and which has far better erosion resistance than conventional nickel alloy ground electrodes. In fact, the erosion resistance of the ground electrode of an igniter according to the instant invention is comparable to that of the ground electrode structure disclosed in Van Uum et al. In a preferred embodiment, the configuration of the spark igniter of the instant invention minimizes the stresses which occur as a consequence of different coefficients of thermal expansion between an insert of an oxidation and erosion resistant material such as iridium and an annular ground electrode containing the insert. The igniter comprises a metal shell having a firing end which terminates at its lower end in an annular ground electrode, an insulator, a center electrode and a plurality of inserts embedded within and bonded to the metal shell. The insulator is sealed within the metal shell and has a central bore within which the center electrode is sealed and a surface extending inwardly toward the bore from the ground electrode. The center electrode has a firing end which is in spark gap relation with the ground electrode of the metal shell and is so positioned that a spark discharge between the firing end and the ground electrode occurs along the inwardly extending surface of the insulator. The inserts are composed of an oxidation and erosion resistant material, preferably iridium, platinum, rhodium, ruthenium, osmium, or an alloy or ductile alloy of one of the foregoing metals and, for service where it is not heated to temperatures higher than about 1000° F., tungsten and its alloys and ductile alloys.

DETAILED DESCRIPTION OF THE INVENTION

Figure 1:
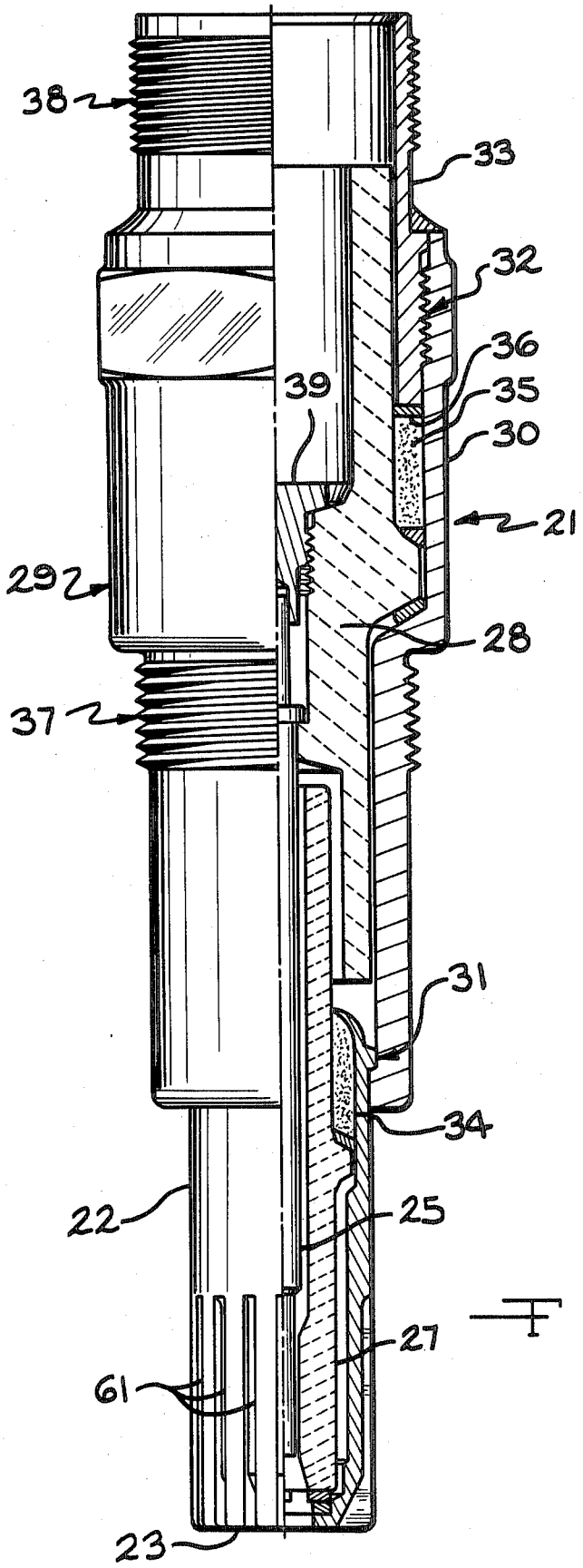
FIG. 1 is a view in elevation, partially in section, of an igniter according to the instant invention.
Figure 2:
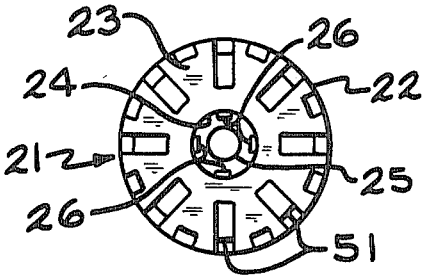
FIG. 2 is an end view of the igniter of FIG. 1.
Figure 5:
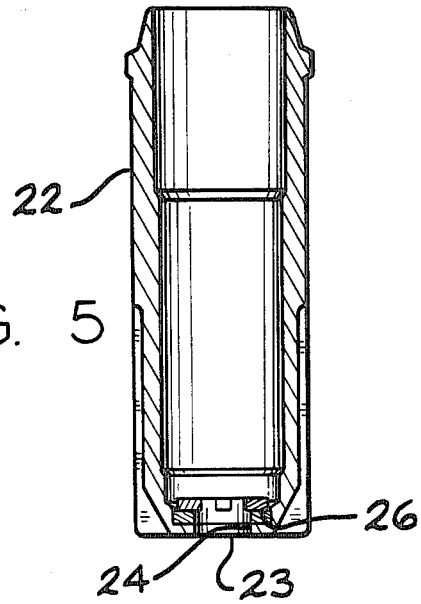
FIG. 5 is a view in vertical section of a shell assembly which is a part of the igniter of FIGS. 1 and 2.
Figure 6:
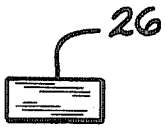
FIG. 6 is a side view of an insert which is a part of the igniter of FIGS. 1 and 2 and of assemblies of FIGS. 3–5.

An igniter according to the instant invention is indicated generally at 21 in FIGS. 1 and 2. The igniter 21 comprises a metal shell 22 having a firing end 23 which terminates at its lower end in an annular ground electrode having a surface 24 (FIG. 2) which is in spark gap relation with a center electrode 25. There are four iridium inserts 26 in the annular ground electrode at the firing end 23 of the igniter 21. The inserts 26 extend radially inwardly beyond the surface 24 of the annular ground electrode toward the center electrode 25. The iridium inserts 26 are rectangular in cross section (FIG. 6) and are embedded within and bonded to, for example by a brazing operation, the firing end 23 (FIGS. 1 and 5) of the metal shell 22.

The igniter 21 also includes a lower insulator 27 (FIG. 1) and an upper insulator 28. The lower insulator 27 is sealed within the metal shell 22, while the upper insulator 28 is sealed within a composite upper shell 29. The upper shell 29 comprises an outer shell part 30 which engages the shell 22 as indicated generally at 31 and is threaded at 32 to an inner shell part 33. The lower insulator 27 is sealed to the shell 22 by a body 34 of compacted talc, while the upper insulator 28 is sealed to the outer shell 30 by a body 35 of talc which is compacted by an end 36 of the inner shell 33. The outer shell 30 is threaded at 37 for engagement with a turbine engine while the inner shell 33 is threaded at 38 for engagement with an ignition harness of the turbine engine. The igniter 21 also includes a terminal 39 which is threaded into the upper insulator 28 and is in electrical contact with the center electrode 25.

Figure 3:
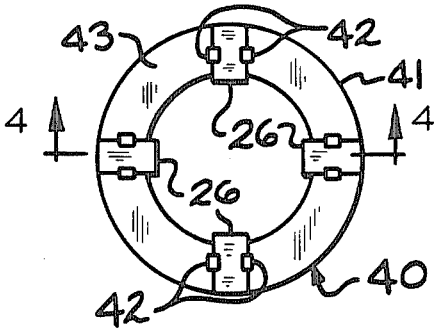
FIG. 3 is a plan view of an assembly that is used in producing the igniter of FIGS. 1 and 2.
Figure 4:
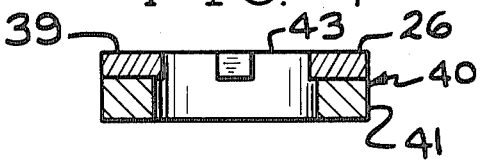
FIG. 4 is a vertical sectional view of the assembly of FIG. 3, taken along the line 4—4.

As best seen in FIG. 3, the metal shell 22 with the iridium inserts 26 embedded therein and bonded thereto can readily be produced by brazing or otherwise bonding a sub-assembly 40 to a cooperating shell part (not illustrated) to produce the shell 22. The sub-assembly 40 comprises an annular ring 41 in which the iridium inserts 26 are staked by arms 42 in rectangular slots in a surface 43 thereof. The annular ring 41 is made of inconel or other suitable nickel alloy. When the assembly 40 is brazed or otherwise bonded to the cooperating part (not illustrated) to produce the shell 22, the annular ring 41 becomes an integral part of the shell 22 and, simultaneously, the iridium inserts 26 are bonded within and to the shell 22.

Figure 10:
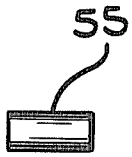
FIG. 10 is a plan view of an insert which is a part of the metal shell of FIGS. 8 and 9.
Figure 8:
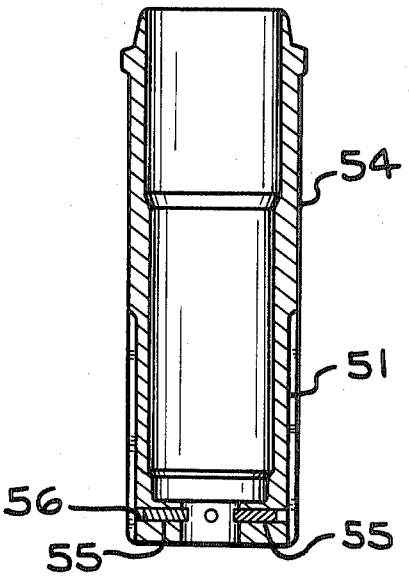
FIG. 8 is a view in vertical section of the metal shell of an igniter similar to that of FIGS. 1 and 2, but constituting another embodiment of an igniter according to the invention.
Figure 9:
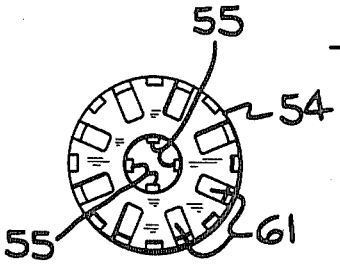
FIG. 9 is an end view of the metal shell of FIG. 8.
Figure 11:
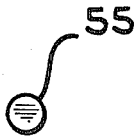
FIG. 11 is an end view of the insert of FIG. 10.

A spark igniter according to the invention can also be produced by substituting a shell 54, FIGS. 8 and 9 for the identically shaped shell 22 in the igniter 21 of FIG. 1. Referring again to FIGS. 8 and 9, the shell 54 is made of inconel or other suitable nickel alloy, and has iridium inserts 55 brazed or otherwise bonded in bores 56 of the shell 54. As best seen in FIGS. 10 and 11, the inserts 55 are cylindrical in shape, matching the bores 56.

Figure 7:
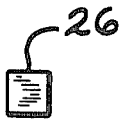
FIG. 7 is an end view of the insert of FIG. 6.
Figure 12:
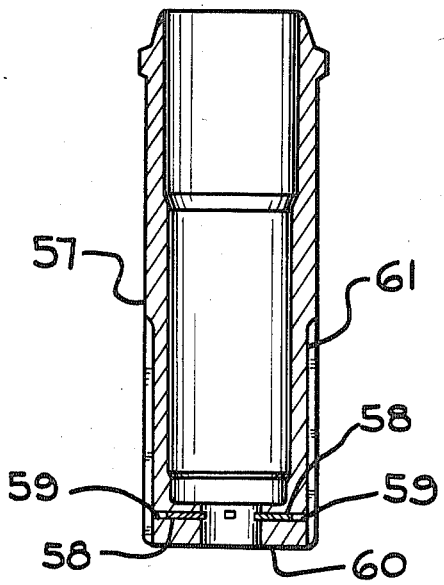
FIG. 12 is a view in vertical section of the shell of still another embodiment of an igniter according to the present invention.
Figure 13:
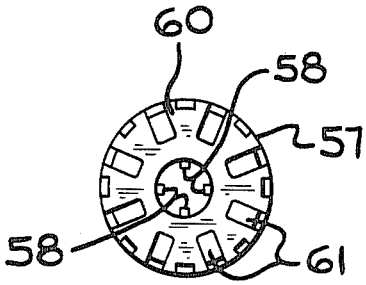
FIG. 13 is an end view of the shell of FIG. 12.

An igniter according to the instant invention can also be produced from a shell 57, FIGS. 12 and 13, having iridium inserts 58 brazed or otherwise bonded in slots 59 which are adjacent the firing end 60 thereof. The inserts 58 are rectangular in cross section, having the same configuration as the inserts 39 of FIGS. 6 and 7.

Two igniters 21 having shells 22 were fabricated and subjected to endurance testing to evaluate the erosion resistance of a nickel alloy annular ground electrode having four iridium inserts 26. Each insert 26 measured 0.030 inch by 0.030 inch by 0.074 inch. The igniters 21 were tested in a high temperature/pressure test fixture and fired by a conventional ignition system. During testing, pressure in the test fixture was maintained at about 75 psig. and the temperature (as measured by a thermocouple) of the firing end 23 of the igniters 21 was maintained at 1500° F. The igniters 21 were sparked approximately 105 times per minute in cycles consisting of 50,000 sparks per igniter 21. The igniters 21 were tested to failure which was defined as either an inability to spark at 75 psig. or ground electrode erosion which exceeded a predetermined value. Both igniters withstood 1,400,000 sparks before failure due to excessive ground electrode erosion.

One additional igniter according to the instant invention was fabricated and endurance tested. This igniter was similar to igniter 21 except that the shell 54 (FIGS. 8–9) was substituted for the shell 22 of the igniter 21 (FIG. 1). The iridium inserts 55 (FIGS. 10 and 11) were 0.074 inch long and had diameters of 0.048 inch. The endurance testing was identical to that described above in connection with igniters 21 except that a cycle constituted 100,000 sparks instead of 50,000 sparks. This test ended when the igniter failed due to inability to produce a spark under 75 psig. after sparking 2,213,500 times. This constitutes a 63 percent improvement in expected service life over that of the igniters 21.

For purposes of comparison but not in accordance with the instant invention, two additional, conventional igniters were fabricated and subjected to the endurance testing described above in connection with igniters 21. These igniters were similar to the igniter 21 except that they did not have iridium inserts; their ground electrodes were made entirely of inconel. The test was terminated when both igniters failed due to excessive electrode erosion. One igniter produced 650,000 sparks; the other produced 700,000.

Thus, it will be seen that an igniter according to the instant invention has a drastically improved expected service life by comparison with conventional igniters having nickel alloy ground electrodes. Moreover, the increased service life of an igniter according to the instant invention is achieved at a fraction of the material and fabrication costs attributable to an igniter of the type disclosed in Van Uum et al.

The shell 22 of the igniter 21, FIG. 1, and the shells 54 and 57 of FIGS. 8 and 12, have grooves 61 extending longitudinally thereof adjacent their respective firing ends. The grooves 61 are frequently used in igniters to facilitate cooling thereof and form no part of the instant invention.

It will be apparent that various changes and modifications can be made from the specific details of the igniter shown in the attached drawings and described in connection therewith without departing from the spirit and scope of the invention as defined in the appended claims. For example, while the invention has been shown and described in connection with an igniter having iridium inserts adjacent its firing end, inserts made of any other oxidation and erosion resistant material can also be used. The most common materials having the requisite degree of oxidation and erosion resistance in addition to iridium, are platinum, rhodium, ruthenium, osmium, alloys and ductile alloys of the named metals and, for service where it is not heated to temperatures higher than about 1000° F., tungsten and its alloys and ductile alloys. Because of their refractory nature, parts composed of the named metals are frequently made by powder metallurgical techniques and may be comparatively brittle immediately after sintering. Such brittleness can usually be reduced to acceptable limits by working the parts at comparatively low temperatures, for example in the vicinity of 2000° F. It is sometimes desirable to increase the ductility of such materials; this can be done by producing so-called ductile alloys: refractory metal powders are blended with other metal powders, for example nickel and copper or nickel and iron, which form a comparatively low melting phase which, upon firing, bonds the refractory metal particles together, forming a matrix which is ductile by comparison with the pure refractory metal. Iridium is the preferred insert material, the embodiment of FIGS. 8–11 constituting the best mode presently known to the inventor.

What I claim is:

1. An igniter comprising a shell of a shell metal alloy which is resistant to spark erosion and corrosion, said shell having a firing end which terminates at its lower end in an annular ring, an insulator sealed within said metal shell and having a central bore and a surface extending inwardly toward the bore from the annular ring, a center electrode sealed within the bore of said insulator and having a firing end which is in spark gap relation with the annular ring of said shell and so positioned that a spark discharge between the firing end and the annular ring occurs along the inwardly extending surface of said insulator, and a plurality of oxidation and erosion resistant inserts, each of said inserts comprising a body of a metal selected from the group consisting of iridium, osmium, ruthenium, rhodium, platinum, and tungsten or an alloy or a ductile alloy of one of the foregoing metals, each of said bodies being embedded within a matching opening which extends from the exterior of said shell through the annular ring, being bonded to said shell, and having an exposed surface which extends inwardly from the annular ring toward the firing end of said center electrode and having a surface adjacent to the inwardly extending surface of said insulator, whereby the annular ring and said inserts together constitute a ground electrode.

2. An igniter as claimed in claim 1 wherein each of said oxidation and erosion resistant inserts is in the annular ring of said shell and extends generally radially thereof.

3. An igniter as claimed in claim 2 wherein each of said inserts is composed of iridium.

4. An igniter as claimed in claim 1 wherein each of said inserts is composed of iridium.

5. An igniter comprising a shell of a shell metal alloy having a firing end which terminates at its lower end in an annular ring, an insulator sealed within said shell and having an axially extending central bore and a surface seated on the annular ring and extending inwardly toward the bore from the annular ring, a center electrode seated within the bore of said insulator and having a firing end which is in spark gap relation with the annular ring of said shell and so positioned that a spark discharge between the firing end and the annular ring occurs along the inwardly extending surface of said insulator, and a plurality of oxidation and erosion resistant inserts, each of said inserts comprising a body embedded within a matching opening which extends from the exterior of said shell through the annular ring of said shell, each of said bodies being brazed to said shell and each of said bodies having an exposed surface which extends inwardly from the annular ring toward the firing end of said center electrode, whereby the annular ring and the inserts together constitute a ground electrode.

6. An igniter as claimed in claim 5 wherein each of said inserts is composed of iridium, platinum, rhodium, ruthenium, osmium, tungsten or an alloy or a ductile alloy of one of the foregoing metals.

* * * * *

US004771209B1

REEXAMINATION CERTIFICATE (2876th)

United States Patent [19] [11] B1 4,771,209

Ryan [45] Certificate Issued May 14, 1996

[54] SPARK IGNITER HAVING PRECIOUS METAL GROUND ELECTRODE INSERTS

[75] Inventor: Nolan A. Ryan, Toledo, Ohio

[73] Assignee: Champion Spark Plug Company, Toledo, Ohio

Reexamination Request:
No. 90/003,604, Oct. 17, 1994

Reexamination Certificate for:

| | |
|---|---|
| Patent No.: | **4,771,209** |
| Issued: | **Sep. 13, 1988** |
| Appl. No.: | **592,288** |
| Filed: | **Mar. 22, 1984** |

Related U.S. Application Data

[63] Continuation-in-part of Ser. No. 333,440, Dec. 22, 1981, which is a continuation of Ser. No. 86,755, Oct. 22, 1979, abandoned.

[51] Int. Cl.[6] ..... H01T 13/32

[52] U.S. Cl. ..... 313/140; 313/141

[58] Field of Search ..... 313/140, 141, 313/139, 142; 123/169 EL

[56] References Cited

U.S. PATENT DOCUMENTS

| | | | |
|---|---|---|---|
| 995,989 | 6/1911 | Schaefer, Jr. . | |
| 1,312,317 | 6/1919 | Gerken . | |
| 1,922,661 | 4/1931 | Curtis | 123/169 |
| 2,108,525 | 2/1938 | Carrington | 123/119 |
| 2,198,250 | 4/1940 | Hurley | 123/169 |
| 2,292,974 | 4/1942 | Smithells | 123/169 |
| 2,344,597 | 3/1944 | Chaston et al. | 123/169 |
| 2,586,864 | 8/1950 | Rose | 123/169 |
| 2,591,718 | 4/1952 | Paul | 123/169 |
| 2,614,548 | 10/1952 | Dutterer et al. | 123/169 |
| 2,640,474 | 6/1953 | Phillips | 123/169 |
| 2,648,320 | 8/1953 | Phillips et al. | 123/169 |
| 2,652,043 | 9/1953 | Johnson | 123/169 |
| 2,712,685 | 7/1955 | Johnson et al. | 29/25.12 |
| 2,927,238 | 3/1960 | Candelise | 313/145 |
| 3,146,370 | 8/1964 | Van Duyne et al. | 313/118 |
| 3,691,419 | 9/1972 | Van Uum | 313/138 |
| 3,725,715 | 4/1973 | Krow | 313/131 |
| 3,958,144 | 5/1976 | Franks | 313/138 |

FOREIGN PATENT DOCUMENTS

| | | |
|---|---|---|
| 2421585 | 1/1975 | Germany . |
| 2530368 | 1/1977 | Germany . |
| 549768 | 12/1942 | United Kingdom . |
| 1129455 | 10/1968 | United Kingdom . |
| 1322303 | 7/1973 | United Kingdom . |

*Primary Examiner*—Sandra L. O'Shea

[57] ABSTRACT

A spark igniter is disclosed. The igniter comprises a metal shell having a firing end which terminates at its lower end in an annular ground electrode, an insulator, a center electrode and a plurality of inserts embedded within and bonded to the metal shell. The insulator is sealed within the metal shell and has a central bore within which the center electrode is sealed and a surface extending inwardly toward the bore from the ground electrode. The center electrode has a firing end which is in spark gap relation with the ground electrode of the metal shell and is so positioned that a spark discharge between the firing end and the ground electrode occurs along the inwardly extending surface of the insulator. The inserts are composed of an oxidation and erosion resistant material, for example iridium, platinum, rhodium, ruthenium, osmium, tungsten or an alloy or ductile alloy of one of the foregoing metals.

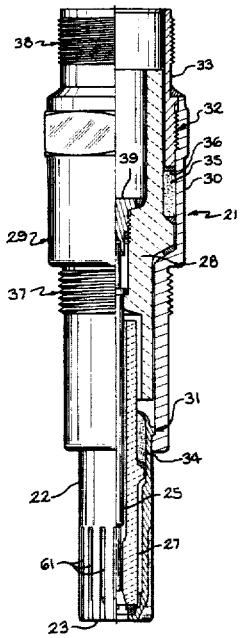

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–6 is confirmed.

* * * * *